United States Patent [19]

Baruffa et al.

[11] Patent Number: 4,768,452

[45] Date of Patent: Sep. 6, 1988

[54] SEWING MACHINE

[76] Inventors: Olindo Baruffa, 5, route d'Ambilly, 1226 Thonex (Geneva); Antonio Jimenez, 6, rue de la Prulay, Meyrin; Francis Plomb, 64, av. du Lignon, 1219 Le Lignon, all of Switzerland

[21] Appl. No.: 710,180

[22] Filed: Mar. 11, 1985

Related U.S. Application Data

[63] Continuation of Ser. No. 563,758, Dec. 21, 1983, abandoned.

[30] Foreign Application Priority Data

Dec. 23, 1982 [CH] Switzerland ..... 7537/82

[51] Int. Cl.[4] ..... D05B 55/14; D05B 3/02

[52] U.S. Cl. ..... 112/443; 112/221

[58] Field of Search ..... 112/221, 158 R, 443, 112/459

[56] References Cited

U.S. PATENT DOCUMENTS

| | | | |
|---|---|---|---|
| 2,662,495 | 12/1953 | Parry | 112/158 R |
| 2,932,268 | 4/1960 | Johnson | 112/221 |
| 4,246,855 | 1/1981 | Johnson | 112/158 R |
| 4,425,859 | 1/1984 | Ishitani | 112/158 R |
| 4,458,611 | 7/1984 | Arendash | 112/158 R |

*Primary Examiner*—Wm. Carter Reynolds

[57] ABSTRACT

The needle bar (1) engaged in a pivoting cradle (2) is integral with a journal (3) connected by a connecting member (8) to a link (4) driven from the drive shaft (12) of the machine. In order to permit the head (23) of a loop holding member (25), mounted in the pedestal of the sewing machine, to engage in a loop (29) of the needle thread (27) during the ascending course of the needle (22), whatever may be its decentration, the connecting member (8) is formed by a bent extension of the crank pin of the link (4) engaged in a bore (7) of the journal (3).

4 Claims, 3 Drawing Sheets

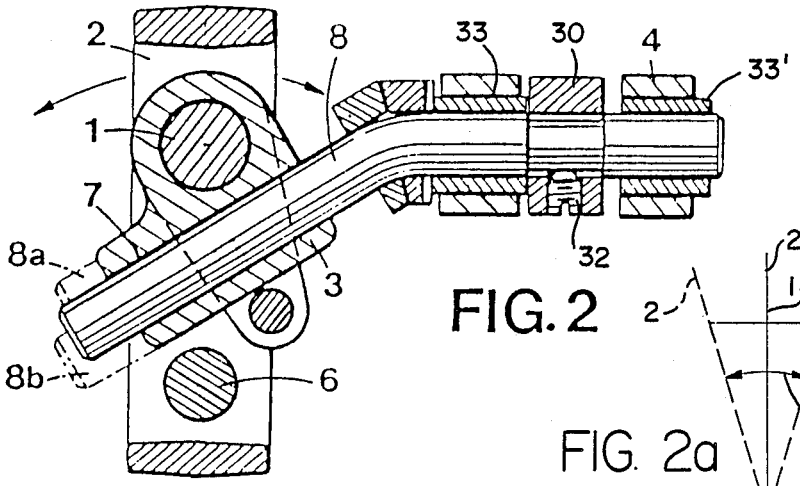
FIG. 2
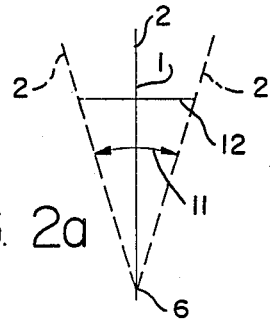
FIG. 2a
FIG. 3
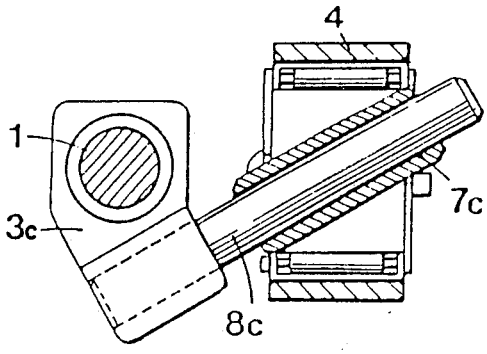
FIG.5
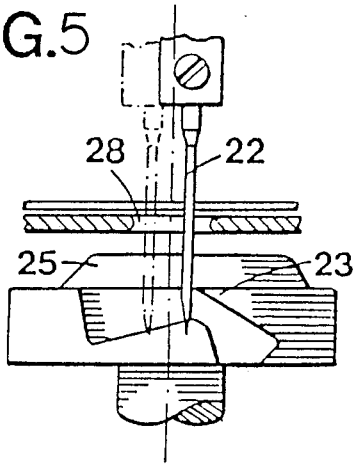
FIG.4
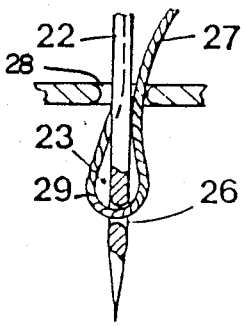

SEWING MACHINE

This is a continuation of application Ser. No. 563,758, filed 12/21/83, now abandoned.

The invention has for its object a zig-zag stitch sewing machine in which the needle bar passes through a cradle mounted on a rotating axle on the frame of the machine. The needle bar is made integral with a journal connected to a rod of a disc crank mounted on the main drive shaft of the machine.

In order to improve the knotting conditions of the upper thread to the lower thread of the machine in the extreme positions of the stitches in zig-zag sewing by means of a loop taker associated with a spool of thread, it has been proposed in U.S. Pat. No. 2,652,795 to incline the the axis of rotation of the loop taker. However, the lateral position of the needle attached to the needle bar, and its relative position, with reference to the beak of the loop taker, varies in such a way that the loop of the needle thread, formed at the time of the ascent of the needle, is not accurately assured in all circumstances.

In order to obviate this inconvenience, the sewing machine according to the invention is characterized in that the connection member from the journal to the rod is arranged in a manner to shift the longitudinal course of the needle bar with reference to the beak of a loop taker as a function of lateral displacement of the needle bar.

The attached drawing shows schematically and by way of example a form of execution of the machine according to the invention.

FIG. 2 is a view partially in section according to II—II of FIG. 1.

FIG. 2*a* is a schematic representation of the needle cradle of FIG. 2 showing its various vertical positions in dashed lines.

FIG. 3 is a partial view similar to FIG. 2 of a modification.

FIG. 4 shows a needle in which the thread of the needle is engaged.

FIG. 5 shows two positions of the needle with reference to the head of the loop holding member.

Figure 6:
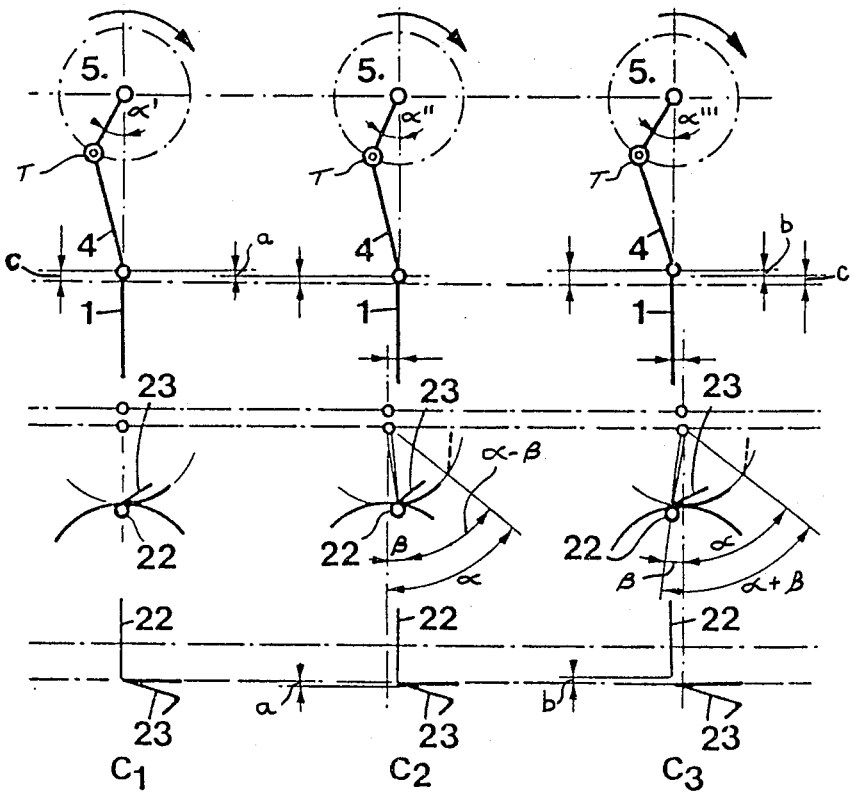

FIG. 6 shows schematically some different positions of the needle and of its driving members with reference to the beak of the loop taker.

Figure 1:
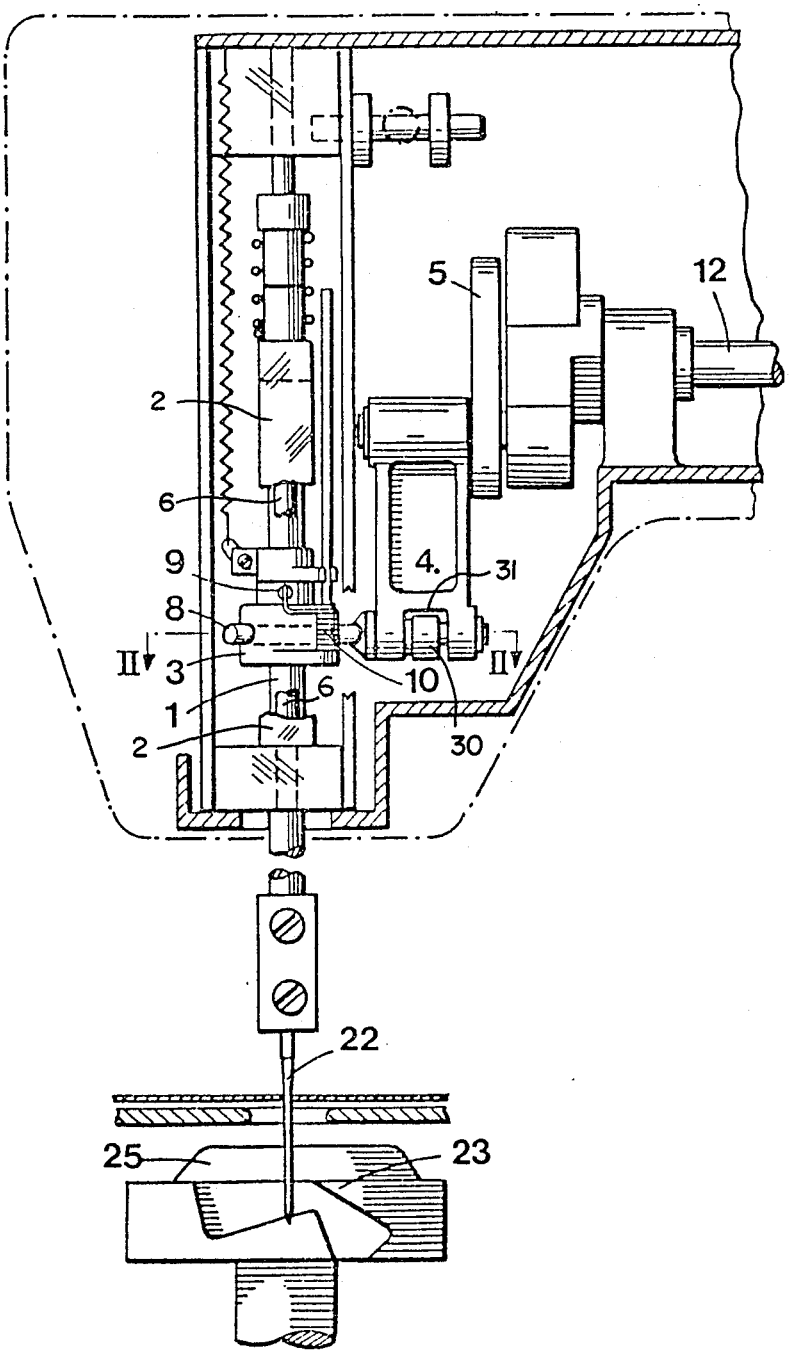
FIG. 1 is a view partially in longitudinal section of the head of the machine and the loop taker lodged in the lower part of the machine.

As shown in FIGS. 1 and 2, the needle bar 1 is mounted in a sliding manner in a cradle 2 and is integral with a journal 3 coupled, by a connection member 8, to a rod 4 of a disc crank 5 for driving the needle bar 1. The cradle 2 is pivotally mounted on an oscillating axle 6 and the journal 3 presents a bore 7 in which is engaged a bent extension of the connection member 8. The needle bar 1 is made integral with the journal 3 by a stud 9 that is spring biased in a lateral bore of the needle bar 1 by a spring 10.

As is illustrated in FIG. 2*a*, the cradle 2 and its needle 1 oscillates back and forth along the arc 11 about the pivot 2 between the right hand position and the left hand position shown in dashed lines.

As shown in FIG. 4 the needle 22 is engaged in the needle plate taker hole 28 of the machine. Engaged in the eye 26 is the needle thread 27 which forms a loop 29 at the beginning of the ascending course of the needle.

As shown in FIGS. 1 and 5, the needle 22 is attached by a screw to the lower end of the needle bar 1 and penetrates through the needle plate hole 28 in the vicinity of the loop taker 25 which contains a bobbin that supplies the lower thread.

During the sewing of zig-zag stitches, by means of a conventional machine, the relative position of the needle 22 with reference to the beak 23 of the loop taker 25 varies as the needle 22 is shifted to the right and to the left from a centered position.

In order to correct this inconvenience, the bore 7 of the journal 3 is oriented according to an oblique axis with reference to a plane 12 that includes the vertical axis of the needle 22 at each of the extreme lateral positions of the needle bar 1, that occur during the sewing of the zig-zag stitches as the needle oscillates over arc 11.

According to a first form of execution shown in FIG. 2, the connecting member 8 is connected to rod 4 and journalled for rotation within bearings 33 and 33'. Axial movement is prevented by a collar 30 that is fixed to connecting member 8 by a set screw 32 and positioned within a release 31 between bearings 33 and 33'. Connecting member 8 is provided with a bent extension that slides in a bore 7 of journal 3 so that journal 3 is able to move axially along the bent extension while axial movement of connecting member 8 in relation to rod 4 is prevented.

As shown in FIG. 2, the connection member 8 of the journal 3 with the rod 4 is in a centered position with the needle bar 1 permitting engagement of the beak 3 of the loop taker 25 in the loop 29 of the needle thread 27 for the formation of the stitch in accordance with $C_1$ of FIG. 6.

At the time of the shifting to the left of the needle 22, the bore 7 of the journal 3 slides on the bent extension of the connection member 8 and displaces, consequently, the latter into position 8*a*, shown in dashed lines in FIG. 2. Therefore, rod 4 is angularly displaced in a clockwise direction with reference to the disc crank 5 according to position $C_3$ of FIG. 6. This has the effect of retarding the ascent of the needle 22, in such a way that passage of the beak 23 of the loop taker is behind the needle 22, the loop 29 of the thread being situated substantially at the same level, with reference to the beak 23 of the loop taker, as when the needle 22 is in the centered position.

When the needle 22 is shifted to the right, the bore 7 of the journal 3 slides on the bent extension of connection member 8 and displaces the connection member 8 to position 8*b* shown in dashed lines in FIG. 2. As a consequence, an angular displacement of the rod 4 occurs in the counter clockwise direction with reference to the disc crank 5 according to position $C_2$ of FIG. 6. This has the effect of advancing the ascent of the needle 22 in such a way that the beak 23 of the loop taker is behind needle 22, the loop 29 of the thread being situated substantially at the same level, with reference to the beak 23 of the loop taker as when the needle 22 is in the centered position.

Numerous variations of construction can be envisioned. In fact, as shown in FIG. 3 the connection member 8*c* can be rectilinear and integral with the journal 3*c*, the free end being engaged in an oblique bore 7*c* connected with the rod 4. In addition, the rotary loop taker associated or not with a bobbin of lower thread, could be of the oscillating type.

With reference to FIG. 6, $C_1$, $C_2$ and $C_3$ represent three diagrams showing the relative angular positions of the beak 23 of the rotary loop taker in relation to the rotation of crank pin T, fixed to disc crank 5, when the beak penetrates the loop of needle thread formed at three lateral positions of the needle 22. $C_1$ shows the needle in the centered lateral position with respect to the needle plate hole 28, as shown in FIG. 4. $C_2$ shows the needle 22 shifted to the extreme right of the needle plate hole and $C_3$ shows the needle 22 shifted to the extreme left of the needle plate hole.

For the position $C_1$, when the needle 22 reaches bottom dead center the beak 23 of the rotary loop taker is an angular distance from the needle which is expressed as $\alpha$. When beak 23 travels the valve of this angle, it will be located behind needle 22 and disc crank 5 will have turned an angle $\alpha/2$, expressed as $\alpha'$. By the connection of needle bar 1 with connecting member 8, and rod 4, needle 22 rises a distance c as a result of disc crank 5 rotating through the angle $\alpha'$. This forms loop 29 as seen in FIG. 4, which beak 23 penetrates to assure the formation of the stitch.

For the position $C_2$, when the needle 22 reaches bottom dead center, beak 23 is at an angle $\alpha-\beta$ away from the needle, corresponding to an angular rotation of $(\alpha-\beta)/2$ for disc crank 5, expressed as $\alpha''$. Consequently, needle 22 rises a distance of no more than c-a. The loop would therefore be smaller and be positioned lower in relation of beak 23 in comparison to the position of the loop when the needle is in the centered position. However, when the needle is shifted to the right, connecting member 8 is displaced to position **8*b* which causes connecting rod 4 to pivot in a counterclockwise direction around the crank pin T. This results in causing needle 22 to rise by a complimentary distance a. This ensures that the size and location of the loop being formed are identical with the size and location of the loop formed in relation to beak 23 when the needle 22 is centered within needle plate hole 28**.

For the position $C_3$, when the needle 22 reaches bottom dead center, beak 23 is at an angle $\alpha+\beta$ away from the needle, corresponding to an angular rotation of $(\alpha+\beta)/2$ for disc crank 5 expressed as $\alpha'''$. Consequently needle 22 rises a distance c+b and the loop is larger and higher in relation to the loop formed in the centered position. However, when the needle is shifted to the left, connecting member 8 is displaced to position **8*a*, which causes connecting rod 4 to pivot in a clockwise direction around crank pin T. This results in needle 22 being brought back to an ascending position on which it has risen only a distance of c. This ensures that the size and location of the loop formed are the same as the size and location of the loop formed in relation to beak 23 when the needle 22** is in the centered position.

We claim:

1. A zig-zag sewing machine having a frame and housing a loop taker having a beak, comprising a needle bar, means for laterally displacing said needle bar including a cradle mounted for rotation about an axis of said frame, said needle bar being engaged in said cradle, means for driving said needle bar in reciprocation including a journal integrally connected with said needle bar, a rod, a disc crank, a drive shaft journalled for rotation, said disc crank being drivingly connected with said drive shaft and said rod being driven in reciprocation by said disc crank, and means connecting said rod and said journal together for causing the longitudinal course of said needle bar relative to said beak of said loop taker to be varied as a function of the lateral displacement of the needle bar, wherein said connecting means comprises a connecting member having a first connecting member portion for causing an angular displacement of said rod relative to said disc crank during lateral displacement of the needle bar, said first connecting member portion having an axis oriented obliquely relative to a plane defined by the extreme laterally displaced positions of said needle bar.

2. A zig-zag sewing machine as claimed in claim 1, further comprising said connecting member having first and second ends, said first connecting member portion being a bent extension portion of said connecting member terminating in said first end, said journal having a bore for receiving said first end and said bent extension portion such that said journal freely slides along said bent extension portion, and said connecting member having means for preventing relative axial movement between said connecting member and said rod.

3. A zig-zag sewing machine as claimed in claim 1, further comprising a needle fixed to said needle bar such that said connecting member causes an angular displacement of said rod to permit the obtention of a position of said needle relative to the position of said beak of said loop taker that permits engagement by said beak of the loop of thread formed in all laterally displaced positions of said needle bar.

4. The sewing machine as claimed in claim 1, further comprising said connecting member portion having opposite ends, a guide element connected to said rod, and a bore formed in said journal whereby said connecting member is fixed in said bore at one of said ends and slides in said guide element at the other of said ends.

* * * * *